US007714527B2

(12) United States Patent
Wang et al.

(10) Patent No.: US 7,714,527 B2
(45) Date of Patent: May 11, 2010

(54) GARBAGE CONTAINER AUTOMATICALLY OPENABLE THROUGH INFRARED INDUCTION

(76) Inventors: Xin Wang, 17037 Green Dr., City of Industry, CA (US) 91745; Shenwei Wang, 47, PuShang Zone, JinShan Industrial Area, FuZhou, JuJian (CN); Jiangqun Cheng, 47, PuShang Zone, JinShan Industrial Zone, FuZhou, Jujian (CN)

( * ) Notice: Subject to any disclaimer, the term of this patent is extended or adjusted under 35 U.S.C. 154(b) by 392 days.

(21) Appl. No.: 11/886,804

(22) PCT Filed: Aug. 15, 2005

(86) PCT No.: PCT/CN2005/001263

§ 371 (c)(1),
(2), (4) Date: Sep. 18, 2007

(87) PCT Pub. No.: WO2006/097019

PCT Pub. Date: Sep. 21, 2006

(65) Prior Publication Data

US 2009/0057317 A1 Mar. 5, 2009

(30) Foreign Application Priority Data

Mar. 18, 2005 (CN) ..... 2005 2 0022862 U

(51) Int. Cl.
*E05F 15/20* (2006.01)

(52) U.S. Cl. ..... 318/480; 318/283; 318/286

(58) Field of Classification Search ..... 318/16, 318/264–266, 281–286, 293, 466–468
See application file for complete search history.

(56) References Cited

U.S. PATENT DOCUMENTS

| | | | | |
|---|---|---|---|---|
| 3,831,513 | A * | 8/1974 | Tashman | 100/52 |
| 4,996,467 | A * | 2/1991 | Day | 318/480 |
| 5,329,212 | A * | 7/1994 | Feigleson | 318/16 |
| 6,859,005 | B2 * | 2/2005 | Boliver | 318/480 |
| 2003/0205979 | A1 * | 11/2003 | Papari et al. | 318/466 |
| 2004/0174268 | A1 * | 9/2004 | Scott et al. | 340/686.6 |
| 2005/0258794 | A1 * | 11/2005 | Fukuizumi | 318/480 |
| 2007/0266637 | A1 * | 11/2007 | McGowan | 49/349 |

* cited by examiner

*Primary Examiner*—Bentsu Ro
(74) *Attorney, Agent, or Firm*—Raymond Y. Chan; David and Raymond Patent Firm

(57) ABSTRACT

The garbage container, having a simple structure, a reliable performance, and being easy to install and cost effective, includes a container body, an infrared induction device, a movable cover automatically opened through infrared induction device, an infrared induction device, an automatic cover-opening device connected with the control unit, an output shaft of the driving motor connected with a cable-collecting wheel via a first set of reduction gears. One end of the cable is fixed to the cable-collecting wheel while the other end of the cable is connected with the cover. An output shaft of the cable-collecting wheel is connected with a cam via a second set of reduction gears. The protruding part of the cam is rotated to contact a cover-opening stroke switch and a cover-closing stroke switch respectively. The cover-opening stroke switch and the cover-closing stroke switch are connected respectively with the control unit through a data line.

10 Claims, 6 Drawing Sheets

GARBAGE CONTAINER AUTOMATICALLY OPENABLE THROUGH INFRARED INDUCTION

BACKGROUND OF THE PRESENT INVENTION

1. Field of Invention

The present invention relates to a garbage container, and more particularly to a garbage container with an automatic cover.

2. Description of Related Arts

The existing garbage containers, having an automatic cover, do not have stroke switch, so the opening and closing time of the cover is controlled by a timing device. If the time interval is set longer than the time of actuation for the cover, the driving motor is still electrified after the opening or closing action is completed. In other words, the driving motor is blocked and unable to move after the opening or closing action is completed. If the time interval is set too short, the opening or closing action of the cover cannot be fully completed.

In addition, such automatically openable garbage containers generally use battery as the power source. However, the rotating speed is gradually slowing down as the battery voltage keeps dropping. Therefore, the time of the opening and closing process is changing with respect to the voltage of the battery.

Even through the automatically openable garbage container do have stroke switch, the design of the stoke switch is not proper. Some stroke switches are installed beside the cover, and connected with the space of the garbage container. After used for some time, the stoke switch will be corroded by the gas in the garbage container, which may affect the performance of the stroke switch, such as the contact disabling. Some stroke switches are too complicated to be installed.

SUMMARY OF THE PRESENT INVENTION

A main object of the present invention is to provide an automatically openable garbage container through infrared induction, using the cooperation between the stroke switch and the cam, and coordinating the opening and closing action of the garbage container to switch on or off the driving motor, and to avoid the block of the driving motor.

Another object of the present invention is to provide an automatically openable garbage container through infrared induction, installing the automatic cover-opening device in a casing to avoid switch disabling that may affect the performance of the present invention.

Accordingly, in order to accomplish the above object, the present invention provides an automatically openable garbage container through infrared induction, comprising:

a garbage container, having at least one opening for littering at one side, and a cover mounted on the opening for littering in moveable manner from an opening position to a closing position;

an infrared induction device, mounted in the garbage container above the opening for littering, comprises an infrared transmitting tube and a infrared receiving tube, wherein the infrared transmitting tube transmits infrared pulse signals in front of the opening for littering forming a induction area, and the infrared receiving tube receives the infrared pulse signals reflected by a barrier in the induction area and converts the infrared pulse signals to corresponding electric signals;

an automatic cover-opening device mechanically connected with the cover via a cable; and a control unit communicatively connected with the infrared induction device and the automatic cover-opening device, wherein the automatic cover-opening device comprises:

a driving motor connected with the control unit;

a first set of reduction gears connected to the output shaft of the driving motor to be driven;

a cable-collecting wheel connected with the first set of reduction gears wherein one end of the cable is connected to the cable-collecting wheel, and the other end is connected to the cover;

a second set of reduction gears connecting to the output shaft of the cable-collecting wheel to drive the cable-collecting wheel; and a cam connecting to the output shaft of the second set of reduction gears to be driven, that can rotate to touch a cover-opening stroke switch and a cover-closing stroke switch respectively, wherein the cover-opening stroke switch and cover-closing stroke switch is electrically connected with the control unit via a wire.

Accordingly, the automatic cover-opening device is mounted in a casing mounted on the upper inner side of the garbage container.

Accordingly, when the cover is in opening position, the cam rotates happening to touch the cover-opening stroke switch, meanwhile the cover-opening stroke switch sends a signal to the control unit to control the driving motor to stop rotating, and the friction of the first set of reduction gears, the second set of reduction gears and the driving motor is larger than the weight of the cover.

Accordingly, when the cover is in opening position, the infrared transmitting tube keeps sending infrared pulses signals to the induction area, and the cover does not close until the infrared receiving tube can not receive the infrared pulses signals reflected by the barrier.

Accordingly, when the cover is in closing position, the cam rotates happening to touch the cover-closing stroke switch, meanwhile the cover-closing stroke switch sends a signal to the control unit to control the driving motor to stop rotating.

Accordingly, the garbage container further comprises an electric motor positive and negative turn driving circuit to connect the control unit with the driving motor.

Accordingly, the garbage container further comprises an infrared driving circuit, an amplifying circuit, and a comparative circuit, wherein the control unit is connected with the infrared transmitting tube through the infrared driving circuit, and the infrared receiving tube is connected with the control unit through the amplifying circuit and the comparative circuit.

Accordingly, the output of the first set of reduction gears in mechanically connected with the input of the second set of reduction gears.

Accordingly, the cover is pivotally mounted on a shaft base via a shaft.

Accordingly, the cam comprises two pin rods or swing rods having a predetermined separated angle respectively, wherein the two pin rods or swing rods touch the cover-opening stroke switch and cover-closing stroke switch respectively.

These and other objectives, features, and advantages of the present invention will become apparent from the following detailed description, the accompanying drawings, and the appended claims.

DETAILED DESCRIPTION OF THE PREFERRED EMBODIMENT

Figure 1:
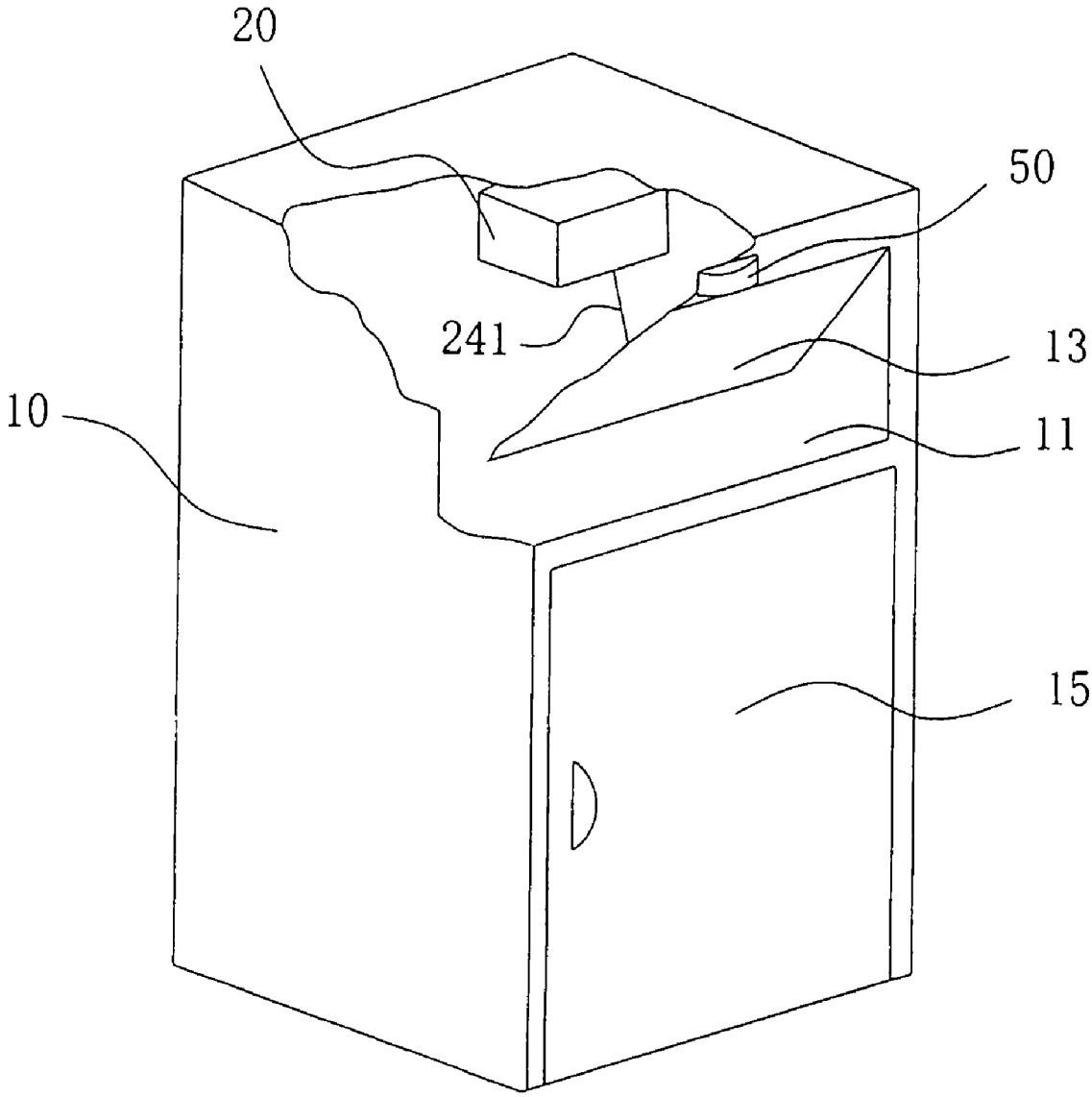
FIG. 1 is a perspective view of an automatically openable garbage container according to a preferred embodiment of the present invention.

Referring to FIG. 1 of the drawings, an automatically openable garbage container according to a preferred embodiment of the present invention is illustrated, in which the garbage container comprises a container body 10 with a cover 13, an automatic cover-opening device 20, an infrared induction device 50, and a control unit communicated with the infrared induction device 50 and the automatic cover-opening device 20, such a microcontroller chip.

The container body 10 has an opening for littering 11 on the side, and a door 15 under the opening for littering 11. The cover 13 is mounted on a shaft base 16 of the container body 10 through a shaft 16, and the cover is moveable between an opening and a closing position. The automatic cover-opening device 20 is connected with the cover 13 through a cable 241. The infrared induction device 50 comprising an infrared transmitting tube and an infrared receiving tube is mounted on the container body 10 above the opening for littering. The infrared transmitting tube transmits infrared pulse signals forming an induction area 56 in front of the opening for littering, and the infrared receiving tube receives the infrared pulse signals reflected by a barrier 60, converts the infrared pulse signals to the corresponding electrical signal, and outputs the electrical signal to the control unit.

When the infrared induction device 50 inducts a barrier 60, the control unit controls automatic cover-opening device 20 to draw back the cable 241, driving the cover 13 from a closing position to an opening position. And contrarily, when the infrared induction device 50 inducts a barrier 60 being away, the control unit controls automatic cover-opening device 20 to release the cable 241, letting the cover 13 from an opening position to a closing position.

Figure 2:
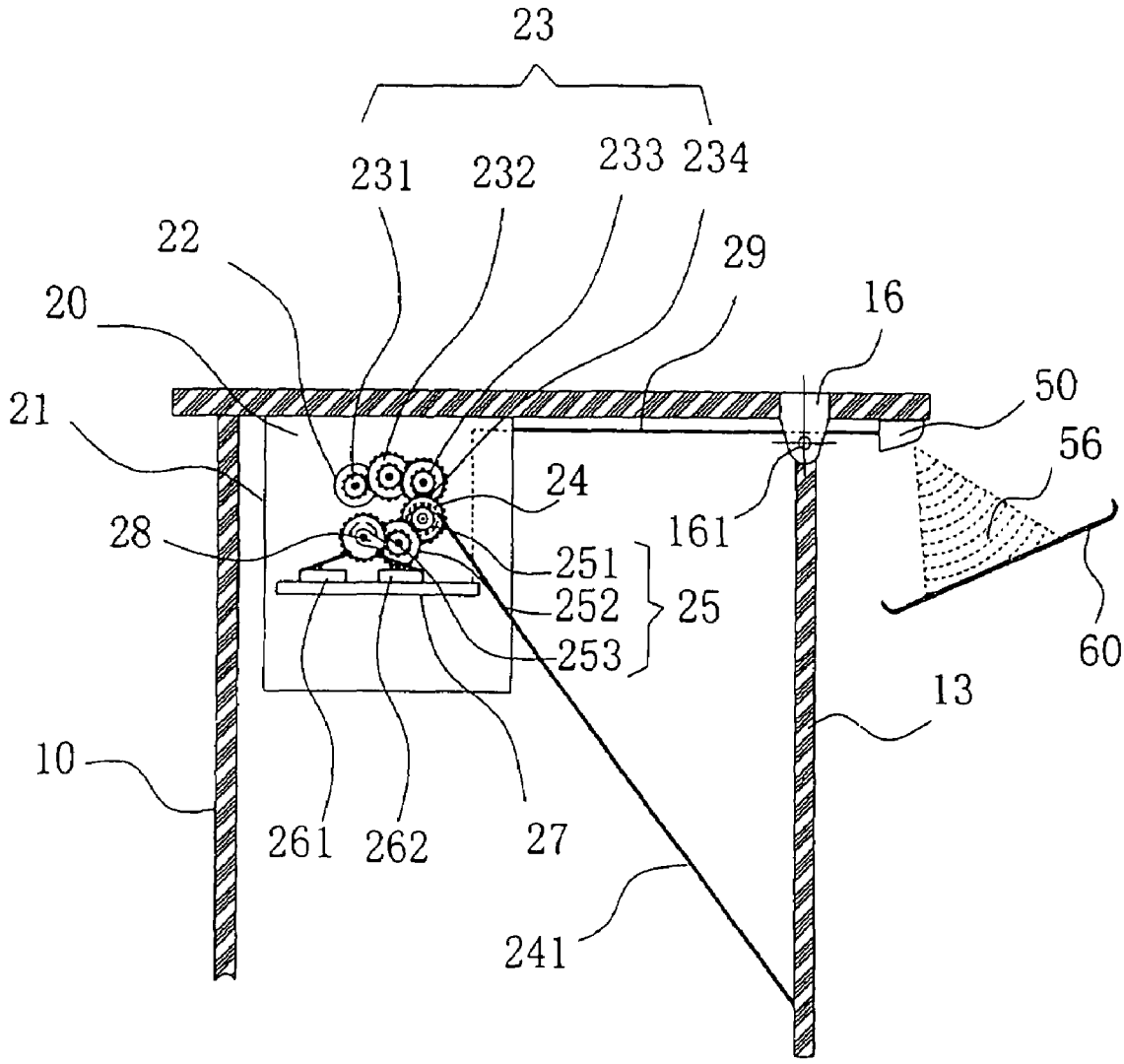
FIG. 2 is a side sectional enlarged view of the automatically openable garbage container according to the above preferred embodiment of the present invention.
Figure 3:
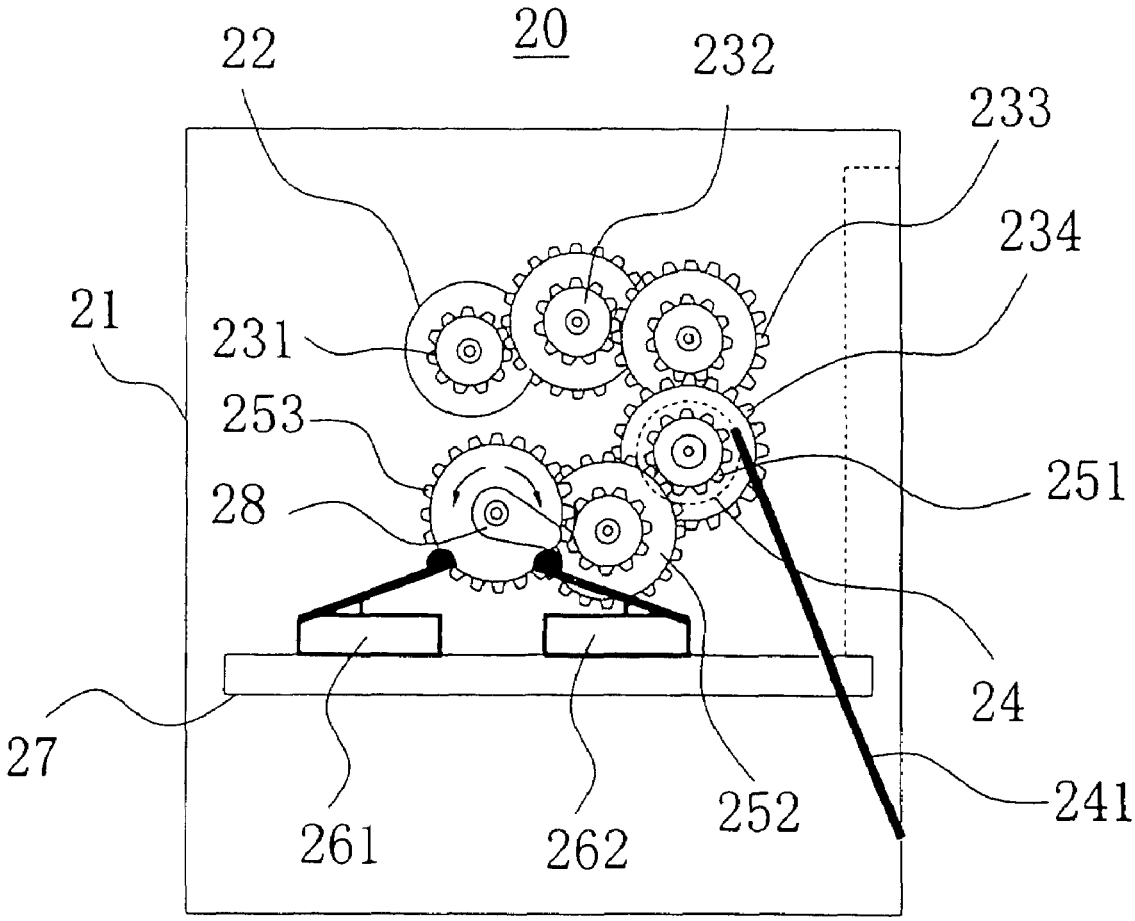
FIG. 3 is an enlarged view of an automatic cover-opening device of the automatically openable garbage container according to the above preferred embodiment of the present invention.

Please referring to FIGS. 2 and 3 of the drawings, the structure of the automatic cover-opening device 20 of the automatically openable garbage container according to a preferred embodiment of the present invention is illustrated. The automatic cover-opening device 20 packed in a casing 21 is mounted on the up and inner side of the container body 10. The automatic cover-opening device 20 in the casing comprises a driving motor 22, a first set of reduction gears 23, a cable-collecting wheel 24, a second set of reduction gears 25, a cover-opening stroke switch 261, a cover-closing stroke switch 262, and a main circuit board 27. The first set of reduction gears 23 comprises two single gears 231 and 234 and two tandem gears 232 and 233, and the second set of reduction gears 25 comprises two single gears 251 and 253 and one tandem gear 252, wherein the single gear 234 and 251 use a same shaft.

Figure 4:
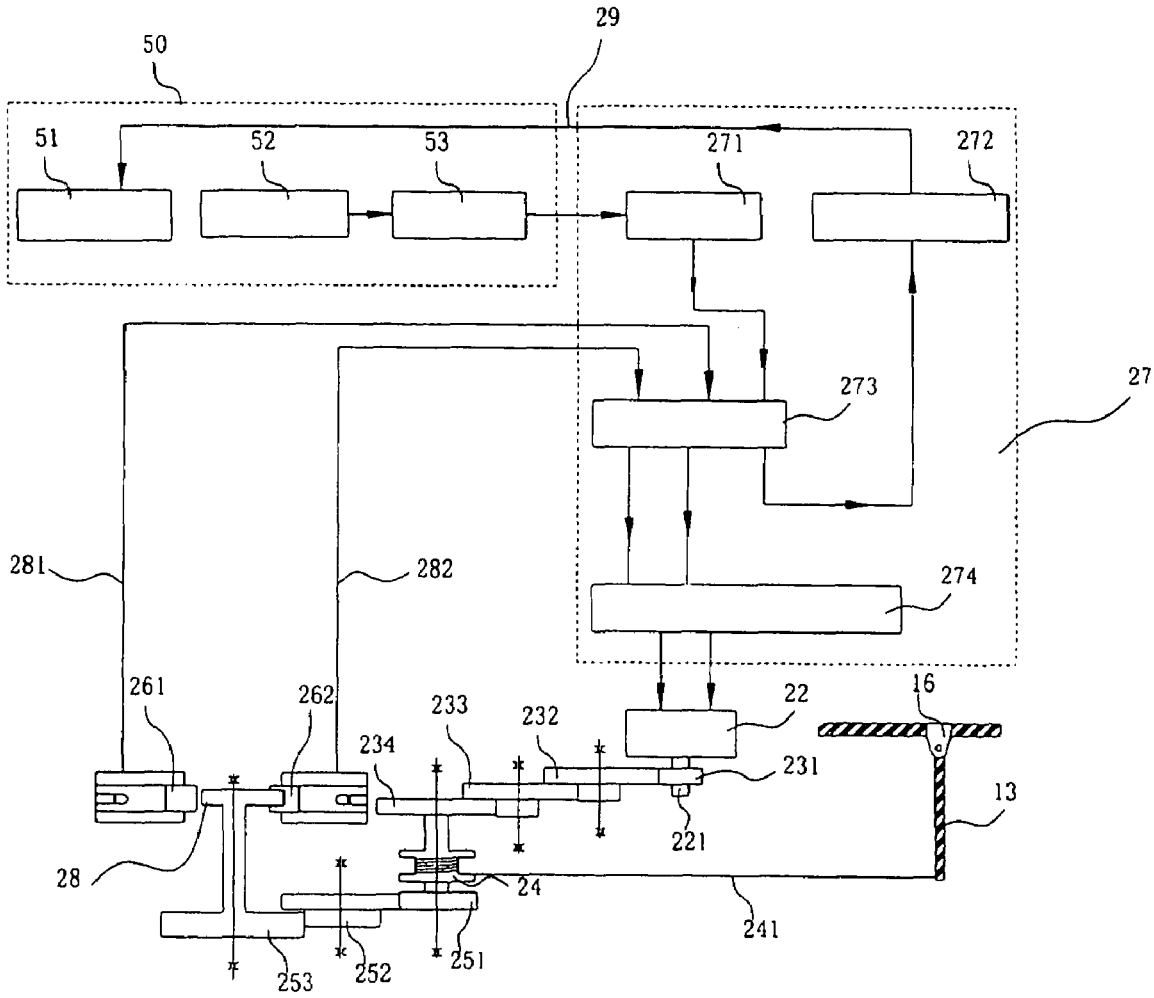
FIG. 4 is a schematic diagram of working principle of the automatically openable garbage container according to the above preferred embodiment of the present invention.

The single gear 231 is disposed on the output shaft 221 of the driving motor 22, driving the gears 232, 233 and 234 in turn though the connection between them. The cable-collecting wheel 24 uses a same shaft with gears 234 and 251. One end of the cable 241 is connected with the cable-collecting wheel 24, and the other end of the cable 241 is connected with the cover 13 through the casing 21. The cable-collecting wheel 24 is mechanically connected with a cam 28 through a connection with gears 251, 252 and 253 in turn. The cam 28 can touch stroke switches 261 and 262 when it rotates. The main circuit board 27 comprises a comparative circuit 271 and an infrared driving circuit 272, a control unit 273, and an electric motor positive and negative turn driving circuit 274, as shown in FIG. 4. The cover-opening stroke switch and cover-closing stroke switch are connected with the control unit 273, such as microcontroller chip, through data lines 281 and 282. The main circuit board 27 is connected with the induction device 50 though a data line 29.

The control unit 273 controls the infrared transmitting tube sending infrared pulse signals to the induction area 56 in a predetermined time interval. When a barrier is close to the induction area 56, the infrared receiving tube receives the infrared pulse signals reflected by the barrier, and sends a control signal to the control unit 273, and then the control unit controls the opening or closing of the cover 13.

To open the cover 13, the driving motor 22 rotates clockwise driving the cable-collecting wheel 24 to rotate anti-clockwise via the first set of reduction gears, and drawing back the cable 241 to drive the cover 13 from a closing position to an opening position. Meanwhile, the output shaft of the cable-collecting wheel 24 drives the cam 28 to rotate via the second set of reduction gears 25. As the cable-collecting wheel 24 rotates anti-clockwise for a few circles, the cover 13 is opened to a maximum extent, the opening position. The cam 28 also rotates anti-clockwise to a certain degree happening to touch the cover-opening stroke switch 261. The cover-opening stroke switch 261 controls the driving motor 22 to stop rotating clockwise via circuit.

To close the cover 13, the driving motor 22 rotates anti-clockwise driving the cable-collecting wheel 24 to rotate clockwise, and releasing the cable 241 to close the cover 13 from a closing position to an opening position by its own weight. As the cable-collecting wheel 24 rotates clockwise for a few circles, the cover 13 is entirely closed, the closing position. Meanwhile, the cam 28 also rotates clockwise to a certain degree happening to touch the cover-closing stroke switch 262. The cover-closing stroke switch 262 controls the driving motor 22 to stop rotating anti-clockwise via circuit.

FIG. 4 illustrates the schematic diagram of electromechanical working principle of the automatically openable garbage container of the present invention. As shown in FIG. 4, three outputs of the control unit 273 are connected with the infrared driving circuit 272 and the electric motor positive and negative turn driving circuit 274 respectively, and the inputs of control unit 273 are connected with the comparison circuit 271, cover-opening stroke switch 261, and cover-closing stroke switch 262 respectively. The infrared receiving tube 52 is connected with the input of an amplifying circuit 53, the output of the amplifying circuit 53 is connected with the input of a comparison circuit 271, and the infrared transmitting tube 51 is connected with the infrared driving circuit 272. In this preferred embodiment, the infrared transmitting tube 51, the infrared receiving tube 52, and the amplifying circuit 53 are disposed in the casing of the infrared induction device 50. The comparison circuit 271, the infrared driving circuit 272, the control unit 273, and the electric motor positive and negative turn driving circuit 274 are mounted on the main circuit board 27.

The operation of the present invention is described explicitly hereinafter with FIG. 2 and FIG. 4.

The control unit 273 controls the infrared transmitting tube 51 via the infrared driving circuit 272 sending infrared pulse signals to the induction area 56 in a predetermined time interval. When a barrier is close to the induction area 56, the infrared receiving tube 52 receives the infrared pulse signals reflected by the barrier 60. The signals are sent to an input of the control unit 273 through the amplifying circuit 53 and the comparison circuit 271. After the control unit 273 receives the signals, the output of the control unit 273 controls the electric motor positive and negative turn driving circuit 274 to make the driving motor 22 rotate clockwise. And the driving motor 22 drives the cable-collecting wheel 24 to rotate anti-clockwise via the first set of reduction gears to enlace the cable 241 to the cable-collecting wheel 24, so the other end of the cable 241 opens the cover 13. As the cover is opened to the maximum extent, the cam 28 rotates anti-clockwise to a certain degree happening to touch the cover-opening stroke switch 261, and then the cover-opening stroke switch 261 sends a signal to the input of the control unit 273 to stop the clockwise rotation of the driving motor 22 via electric motor positive and negative turn driving circuit 274. Because the weight of the cover 13 is less than the friction between the first and second set of reduction gears 23, 24 and the driving motor 22, the cover remains opening. Meanwhile, the infrared induction device 50 keeps transmitting infrared pulse signals to the induction area 56. If the barrier is still in the induction area 56, and the infrared receiving tube 52 receives the infrared pulse signals reflected by the barrier, the cover 13 remains opening.

Once the barrier leaves the induction area 56, and the infrared receiving tube 52 can not receive the infrared pulse signals reflected by the barrier, the cover 13 will remain opening for at most 3 s. And then the control unit 273 controls the electric motor positive and negative turn driving circuit 274 to make the driving motor 22 rotate anti-clockwise. The driving motor 22 drives the cable-collecting wheel 24 to rotate clockwise via the first set of reduction gears to release the cable 241, and the cover 13 closes the opening for littering 11 by its own weight. Meanwhile, the cam 28 rotates clockwise to a certain degree happening to touch the cover-closing stroke switch 262, and then the cover-closing stroke switch 262 sends a signal to the input of the control unit 273 to stop the anti-clockwise rotation of the driving motor 22 via the electric motor positive and negative turn driving circuit 274. When the cover is fully closed, the driving motor stops rotating. Thus an opening and closing process is completed.

Figure 6:
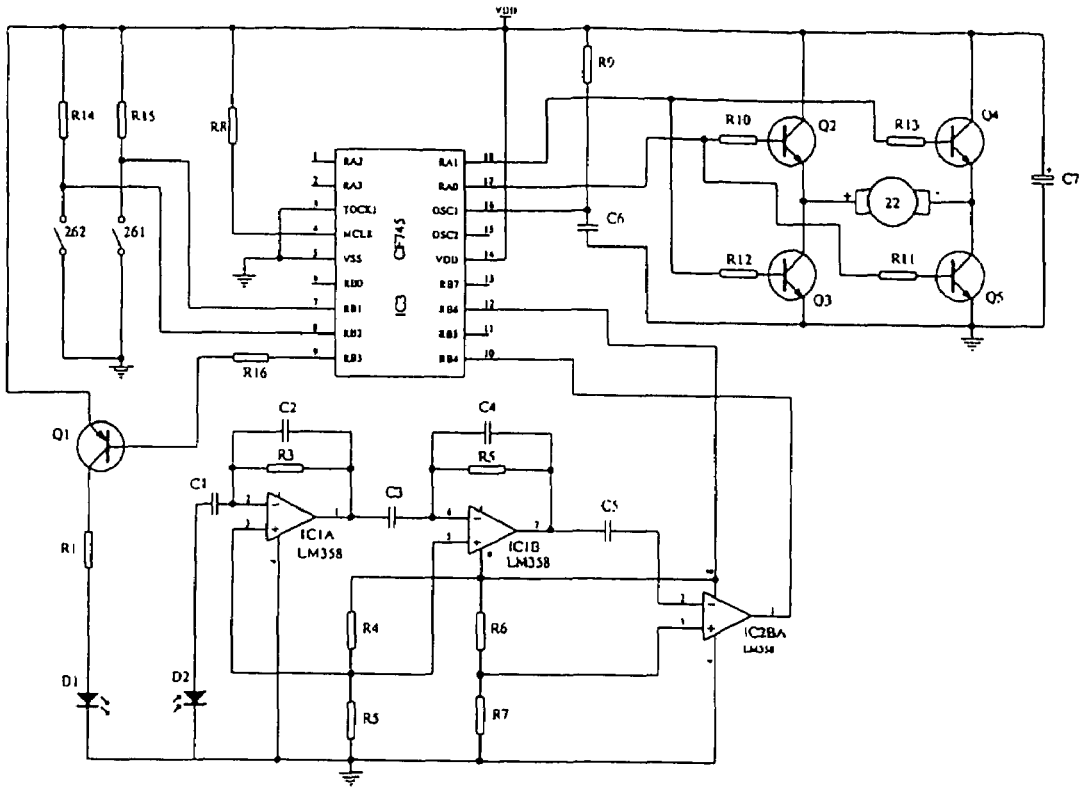
FIG. 6 is a preferred circuit diagram of the automatically openable garbage container according to the above preferred embodiment of the present invention.

Referring to FIG. 6 of the drawings, a preferred circuit diagram according to the present invention is illustrated. The cover-opening strokes 261 and the cover-closing stroke switch 262 are connected with a resistance R15 and a resistance R14 in series respectively, and connected to the two ends of the power source respectively. Meanwhile, the junction of the over-opening strokes 261 and the resistance R15 and the junction of the cover-closing stroke switch 262 and the resistance R14 are connected with a port RB1 and a port RB2 of the microcontroller chip IC3 as the 273 shown in FIG. 4. When the cam 28 touches the cover-opening strokes 261, RB1=0 (low voltage) and RB2=1 (high voltage); when the cam 28 touches the cover-closing stroke switch 262, RB1=1 (high voltage) and RB2=0 (low voltage). The microcontroller chip judges the stopping moments of clockwise or anti-clockwise via the high or low voltage of the ports RB1 and RB2.

Figure 5:
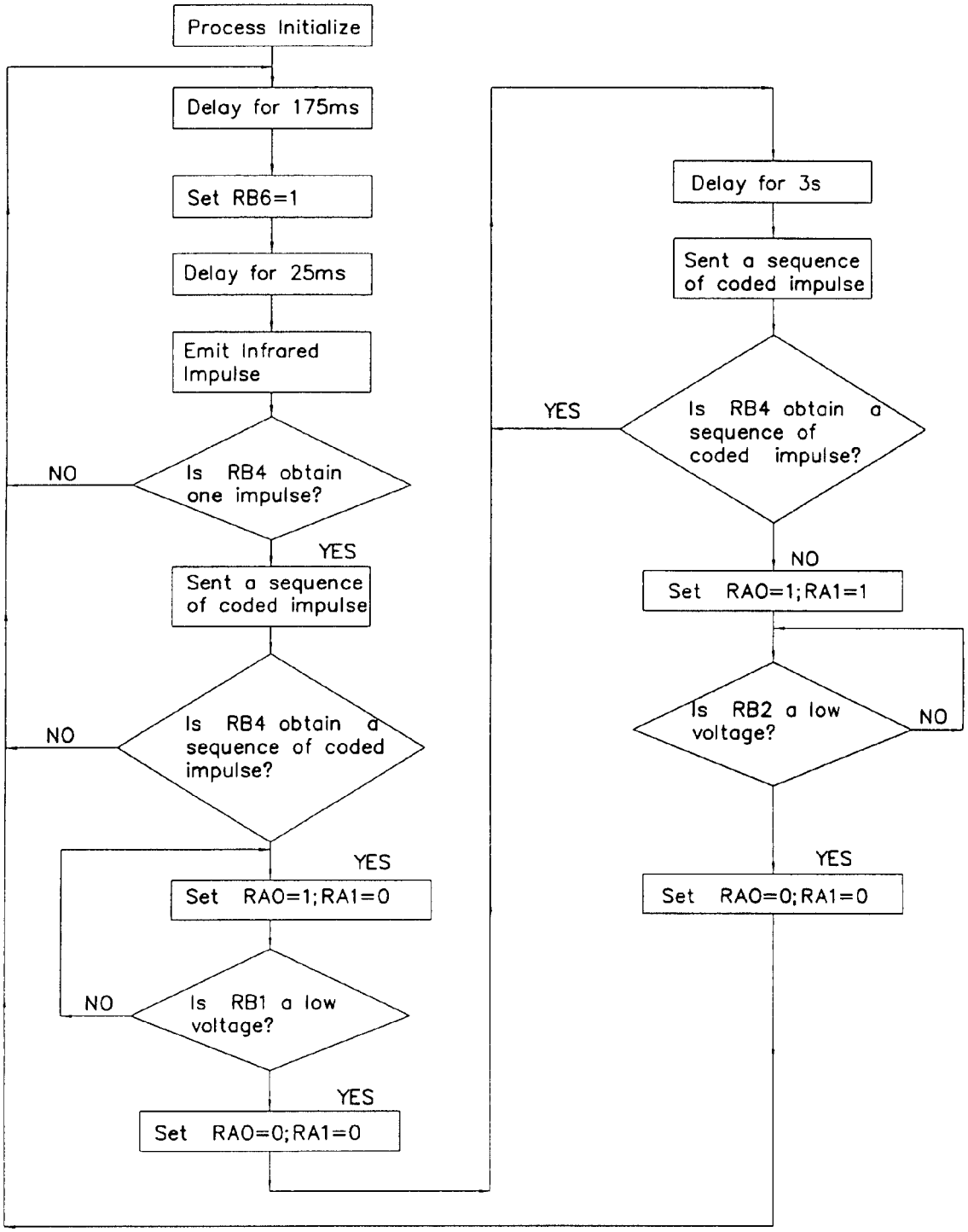
FIG. 5 is a chart flow of the microcontroller chip program of the automatically openable garbage container according to the above preferred embodiment of the present invention.

Referring the flow chart as show in FIG. 5 with FIG. 3 and FIG. 6, when a barrier 60 entering into the induction area 56 is confirmed, the program sets RA0=1 and RA1=0, and the transistors Q2 and Q5 conduct. At this moment, the driving motor 22 is applied with positive voltage to rotate clockwise. As the driving motor drives the cable-collecting wheel 24 and the cam 28 to rotate via sets of reduction gears 23 and 25, the program keeps judging the voltage of the port RB1. When the cam 28 rotates anti-clockwise happening to touch the cover-opening stroke switch 261, the cover-opening stroke switch 261 is switched on. And then the high voltage of the port RB1 turns to low voltage, and the program sets RA0=0 and RA1=0 to cut off Q2 and Q5. The driving motor 22 stops rotating due to no current flow. Then the program controls the port RB3 to send a set of infrared coded pulse to the induction area 56, in order to judge whether the barrier leaves the induction area. If the barrier 60 is still in the induction area, the program makes judgment in 3 s.

Once the barrier leaves the induction area, the program sets RA0=0 and RA1=1. Q3 and Q4 conduct. At this moment, the driving motor 22 is applied with negative voltage to rotate anti-clockwise. As the driving motor drives the cable-collecting wheel 24 and the cam 28 to rotate via sets of reduction gears 23 and 25, the program keeps judging the voltage of the port RB2. When the cam 28 rotates clockwise happening to touch the cover-closing stroke switch 262, the cover-closing stroke switch 262 is switched on. The high voltage of the port RB2 turns to low voltage, and then the program sets RA0=0 and RA1=0 to cut off Q4 and Q3. The driving motor 22 stops rotating due to no current flow. Thus a cover opening and closing process is completed, and then the program returns to be ready for the next process.

The cam described in the present invention mainly has a function of touching the cover-opening and cover-closing stroke switch, not only the concept in the conventional mechanism. The cam in the conventional mechanism is only a special case of the present invention. When the projection portion of the cam is widened, the return angle of the cam needed to touch the cover-opening stroke switch or the cover-closing stroke switch becomes smaller; when the projection portion of the cam is narrowed, the return angle of the cam becomes bigger, so changing the width of the projection portion can adjust the return angle of the cam, so as to adjust the rotation circles of the cable-collecting wheel under the circumstance of the gear ratio unchanged, to change the stroke of the cable 241 to adjust the opening angle of the cover 13 or to be suitable for the garbage container of different size.

Figure 7A:
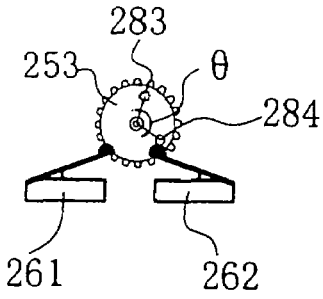
FIGS. 7A and 7B are schematic views of cam structure with pin rods according to the above preferred embodiment of the present invention.
Figure 8A:
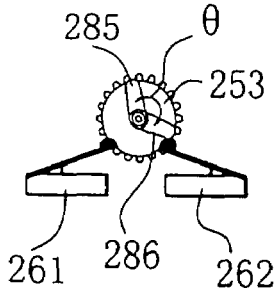
FIGS. 8A and 8B are schematic views of cam structure with swing rods according to the above preferred embodiment of the present invention.
Figure 7B:
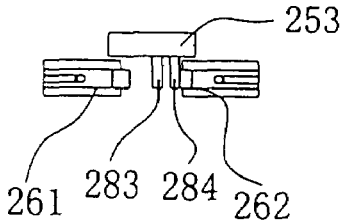
Figure 8B:
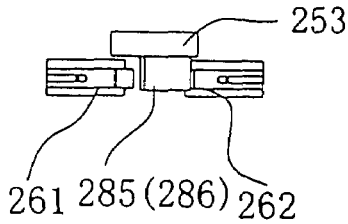

FIGS. 7A, 7B and 8A, 8A illustrate two alternative modes of the cam structure of the present invention. FIG. 7B is the top exterior view of FIG. 7A, and FIG. 8B is the top exterior view of FIG. 8A. As shown in FIGS. 7A, and 7B, the cam structure of the present invention can be replace by two pin rods 283 and 284. The pin rod 283 is in charge of touching the cover-opening stroke switch 261, and the pin rod 284 is in charge of touching the cover-closing stroke switch 262. Two pin rods are fixed on the gear 253, so adjusting the separation angle between the pin rods 283 and 284 can change the stroke of the cable 241.

As shown in FIGS. 8A and 8B, the cam structure of the present invention can be replace by two swing rods 285 and 286. The swing rod 285 is in charge of touching the cover-opening stroke switch 261, and the swing rod 286 is in charge of touching the cover-closing stroke switch 262. Two swing rods are fixed on the gear 253, so adjusting the separation angle between the swing rods 285 and 286 can change the stroke of the cable 241.

The present invention coordinates the opening and closing of the cover through cooperation of the stroke switch and the cam, which effectively avoids the block of the driving motor. The present invention also mounts the automatic cover-opening device such as stroke switch in a casing, such that the performance of the stroke switch can be assured, because the garbage container will not be corroded by the gas in the garbage container to cause the contact disabling. The garbage container has a simple structure, a reliable performance, and is easy to install and cost effective. Further more, the present invention has an automatic cover-opening function through infrared induction controlled by a microcontroller integrating optics and electromechanics.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatically openable garbage container through infrared induction, comprising:

a garbage container, having at least one opening for littering at one side, and a cover mounted on said opening for littering in moveable manner from a opening position to a closing position;

an infrared induction device, mounted in the garbage container above said opening for littering, comprises an infrared transmitting tube and a infrared receiving tube, wherein said infrared transmitting tube transmits infrared pulse signals in front of the opening for littering forming a induction area, and said infrared receiving tube receives the infrared pulse signals reflected by a barrier in said induction area and converts said infrared pulse signals to corresponding electric signals;

an automatic cover-opening device mechanically connected with said cover via a cable; and a control unit communicatively connected with said infrared induction device and said automatic cover-opening device, wherein said automatic cover-opening device comprises:

a driving motor connected with said control unit;

a first set of reduction gears connected to the output shaft of said driving motor to be driven;

a cable-collecting wheel connected with said first set of reduction gears wherein one end of said cable is connected to said cable-collecting wheel, and the other end is connected to said cover;

a second set of reduction gears connecting to the output shaft of said cable-collecting wheel to drive said cable-collecting wheel; and a cam connecting to the output shaft of said second set of reduction gears to be driven, that can rotate to touch a cover-opening stroke switch and a cover-closing stroke switch respectively, wherein said cover-opening stroke switch and cover-closing stroke switch is electrically connected with said control unit via a wire.

2. The automatically openable garbage container through infrared induction, as recited in claim 1, wherein said automatic cover-opening device is mounted in a casing mounted on the upper inner side of said garbage container.

3. The automatically openable garbage container through infrared induction, as recited in claim 2, wherein, when said cover is in opening position, said cam rotates happening to touch said cover-opening stroke switch, meanwhile said cover-opening stroke switch sends a signal to said control unit to control said driving motor to stop rotating, and the friction of said first set of reduction gears, said second set of reduction gears and said driving motor is larger than the weight of said cover.

4. The automatically openable garbage container through infrared induction, as recited in claim 3, wherein, when said cover is in opening position, said infrared transmitting tube keeps sending infrared pulses signals to said induction area, and said cover does not close until said infrared receiving tube can not receive the infrared pulses signals reflected by said barrier.

5. The automatically openable garbage container through infrared induction, as recited in claim 4, wherein, when said cover is in closing position, said cam rotates happening to touch said cover-closing stroke switch, meanwhile said cover-closing stroke switch sends a signal to said control unit to control said driving motor to stop rotating.

6. The automatically openable garbage container through infrared induction, as recited in claim 5, wherein said garbage container further comprises an electric motor positive and negative turn driving circuit to connect said control unit with said driving motor.

7. The automatically openable garbage container through infrared induction, as recited in claim 6, wherein garbage container further comprises a infrared driving circuit, an amplifying circuit, and a comparative circuit, wherein said control unit is connected with said infrared transmitting tube through said infrared driving circuit, and said infrared receiving tube is connected with said control unit through said amplifying circuit and said comparative circuit.

8. The automatically openable garbage container through infrared induction, as recited in claim 7, wherein the output of said first set of reduction gears in mechanically connected with the input of said second set of reduction gears.

9. The automatically openable garbage container through infrared induction, as recited in claim 1, wherein said cover is pivotally mounted on a shaft base via a shaft.

10. The automatically openable garbage container through infrared induction, as recited in claim 1, wherein said cam comprises two pin rods or swing rods having a predetermined separated angle respectively, wherein said two pin rods or swing rods touch said cover-opening stroke switch and cover-closing stroke switch respectively.

* * * * *